US005864879A

United States Patent [19]

Bercane

[11] Patent Number: 5,864,879

[45] Date of Patent: Feb. 2, 1999

[54] CONVERTIBLE JACKET

[76] Inventor: Jean-Luc Bercane, 20 rue E. Guyaux 31200, Toulouse, France

[21] Appl. No.: 894,724

[22] PCT Filed: Oct. 14, 1996

[86] PCT No.: PCT/FR96/01597

§ 371 Date: Aug. 27, 1997

§ 102(e) Date: Aug. 27, 1997

[87] PCT Pub. No.: WO97/16988

PCT Pub. Date: May 15, 1997

[30] Foreign Application Priority Data

Nov. 9, 1995 [FR] France ..... 95/13377

[51] Int. Cl.[6] ..... F41D 3/02

[52] U.S. Cl. ..... 2/93; 2/85

[58] Field of Search ..... 2/93, 69, 83, 85, 2/86, 95, 96, 108, 118, 119, 116, 243.1, 115, 106, 105, 102, 103

[56] References Cited

U.S. PATENT DOCUMENTS

| | | | |
|---|---|---|---|
| 211,426 | 1/1879 | Rogers | 2/93 |
| 258,446 | 5/1882 | Link | 2/83 |
| 339,920 | 4/1886 | Paulme | 2/93 |
| 1,335,505 | 3/1920 | Huntington | 2/93 |
| 2,535,205 | 12/1950 | Harry . | |
| 5,341,514 | 8/1994 | Dale | 2/108 |

FOREIGN PATENT DOCUMENTS

| | | | |
|---|---|---|---|
| 689204 | 11/1966 | Belgium . | |
| 689204 | 4/1967 | Belgium | 2/93 |
| 1386954 | 4/1964 | France . | |
| 1464680 | 1/1967 | France . | |
| 2383619 | 10/1978 | France . | |
| 2593356 | 7/1987 | France . | |
| 602029 | 7/1978 | Switzerland . | |

*Primary Examiner*—Gloria Hale

[57] ABSTRACT

A convertible jacket is provided that can be easily converted between a single breasted configuration and a double breasted configuration. The jacket includes a jacket body having a front median opening defined by opposing vertical edges which are continuous with a horizontal edge at the top of the back of the jacket body. The jacket further includes a jacket dickey model which is attached to the jacket body along the opposing vertical edges and horizontal edge defining the median opening of the jacket body. The jacket dickey model may include a single breasted collar and an edge-to-edge jacket closure to form a single breasted jacket, or may include a double breasted collar and an overlapping jacket closure to form a double breasted jacket. Preferably, the jacket dickey model is attached to the jacket body by a continuous attachment device, such as a zipper.

19 Claims, 3 Drawing Sheets

1
15
13
14
9
8
12
10
11
6
7

2
28
25
27
4
23

3
28
26
27
5
24

32
1
A
A
3

CONVERTIBLE JACKET

FIELD OF THE INVENTION

The present invention relates to a clothing ensemble allowing one to wear a jacket as a single-breasted jacket or a double-breasted jacket. This invention also relates to jacket dickey models designed to complete such a clothing ensemble.

DESCRIPTION OF RELATED ART

Currently, it has already been proposed to achieve alterable clothing by switching at least one detachable element for another. Thus, with example, patent FR 2.383.619 describes a vest with interchangeable pieces of fabric. Patents FR 1.386.954 and U.S. Pat. No. 2,535,245 describe clothing with a detachable, interchangeable collar. Along the same lines, patent FR 2.593.356 describes an article of clothing that can take the form of a coat, a casual jacket, or a dressier jacket with or without sleeves, by adding or removing detachable elements. One can also cite patents FR 1.464.680, CH 602.029 and BE 689.204 that describe jacket bodies to which can be attached, in a detachable fashion, a shirt front or a vest front in order to achieve trompe l'oeil clothing that serves both as a jacket and a shirt or as a jacket and a vest.

BRIEF SUMMARY OF THE INVENTION

The present invention also aims to provide alterable clothing through exchange of a detachable element, and its essential objective is to provide a clothing ensemble that allows one to create a single-breasted jacket, or a double-breasted jacket each having a traditional appearance.

To this end, a clothing ensemble is provided including a jacket body having a frontal median opening with vertical edges extended by a horizontal edge located at the top of the back. These edges are equipped with a detachable continuous attachment device.

According to the invention, this clothing ensemble comprises two jacket dickey models adapted for continuous attachment to the jacket body, each dickey model including in a single piece a front with a cut edge paired with the opening of the jacket body, a collar sham and a jacket collar, and is equipped along its cut edge and collar sham with an attachment device paired with that of the jacket body intended to cooperate with this jacket body. One of the dickey models has an edge-to-edge closure and a single-breasted collar. The other dickey model has an overlapping closure and a double-breasted collar.

It should be noted that the expression "two jacket dickey models" aims to define jacket dickeys allowing one to achieve a single-breasted jacket and a double-breasted jacket respectively. Each "jacket dickey model" may therefore consist of a single jacket dickey or of two or more jacket dickeys.

Therefore, for the purpose of achieving a single-breasted jacket, various jacket dickeys can be created by producing different button fastenings and by giving these jacket dickeys either a tunic collar or a narrow or wide notched lapel collar.

Similarly, in view of achieving a double-breasted jacket, various jacket dickeys can be created by producing different button fastenings and by giving these jacket dickeys either a narrow or wide notched collar.

Such a clothing ensemble is therefore composed of a jacket body and of interchangeable jacket dickeys adapted for completing this jacket body and for giving the ensemble the appearance either of a double-breasted jacket or a single-breasted jacket, giving it either a traditional or sports style.

According to a first variant of the preferred embodiment of the invention, the continuous detachable attachment devices consist of zippers each constituted of two bands edged with teeth, one of said bands comprising a slide equipped with a pull handle:

- the bands of the zippers being sewn onto the reverse side of the jacket body and of each jacket dickey model so that the pull handle of each slide faces toward the inside of the jacket,
- the vertical edges of the jacket body and of the cut edge of each jacket dickey comprising an overlapping border that covers the zippers.

This arrangement of zippers set are in inverse fashion compared to a traditional mounting. Furthermore, they are combined with the presence of overlapping borders allows one to achieve a virtually invisible connection between the jacket body and each jacket dickey model, which gives the jacket a traditional appearance. Moreover, this overlapping border accentuates the jacket body and gives it an original aesthetic quality.

According to a second preferred embodiment variation, the detachable continuous attachment devices consist of zippers each constituted of two bands edged with teeth. One of said bands are comprised of a slide equipped with a pull handle. Said clothing ensemble is characterized in that the zipper bands are sewn along the edges of the jacket body and each jacket dickey model so as to be visible, the pull handles facing toward the outside of the jacket. This arrangement of zippers that remain visible gives an original aesthetic quality to the jacket model.

According to another characteristic of the invention:

- the jacket body is equipped, along its vertical edges and on roughly half of the length of its horizontal edge, with a zipper band equipped with a slide, and along its other vertical edge and on the other half of the length of its horizontal edge, with a zipper band devoid of any slide,
- each jacket dickey model is equipped along its cut edge and collar sham with zipper bands complementary to the corresponding bands of the jacket body so as to form two zipper closures with these latter,
- said zippers being arranged so that each slide is induced to move from the bottom of the jacket toward the jacket collar during attachment of a jacket body and a jacket dickey model.

Owing to this arrangement of the zippers, the slides of these zippers are both at right angles to the jacket collar where they are naturally concealed. Moreover, in the case of a jacket with a traditional appearance, the zipper bands may extend to the lower end of the jacket body and of the jacket dickeys, thereby ensuring a virtually invisible connection along the entire vertical length of the jacket front.

According to another characteristic of the invention, each jacket dickey model comprises a label sewn onto the reverse side of the collar sham in the middle section of this sham that can be turned down over the zipper slides.

In the case of a traditional jacket, such a label on which, notably, can be printed the brand name of the product, is designed to cover the slides of the zippers in order to prevent any potential irritation for the user resulting from the presence of these slides in the collar area.

According to another characteristic of the invention, the pull handle of each zipper slide has a ring shape, each of said slides comprising a tab of a shape suitable so as to lodge itself inside the associated pull handle and to insure that this pull handle is locked into a position in which said pull handle lies flat against said slide.

The design of these slides, whose ring-shaped pull handle is now locked in place by a tab, makes it possible to reduce appreciably the excessive thickness formed by said slides, and results in a jacket without any unattractive excess thickness near the collar and for which the presence of slides at the collar does not irritate the user.

The invention extends to two jacket dickey models adapted so as to be able to be joined continuously with a jacket body having a front median opening with vertical edges extended by a horizontal edge at the top of the back, these edges being equipped with a detachable continuous attachment device.

According to the invention, one of these jacket dickey models comprises in a single piece a front having an edge-to-edge closure and having a cut edge paired with the opening of the jacket body, a collar sham and a jacket collar. Moreover, it is equipped along its cut edge and the collar sham with a detachable continuous attachment device.

The second jacket dickey model comprises in a single piece a front having an overlapping closure and having a cut edge paired with the opening of the jacket body, a collar sham, and a double-breasted collar. It is, moreover, also equipped along its cut edge and collar sham with a detachable continuous attachment device.

BRIEF DESCRIPTION OF THE DRAWINGS

Other characteristics, aims, and advantages of the invention will become clear from the detailed description that follows in reference to the appended drawings that show, by way of non-restrictive examples, two preferred modes of embodiment. In these drawings, which are an integral part of the present invention.

DETAILED DESCRIPTION OF THE INVENTION

Figures 1A, 1B, 1C, 2:
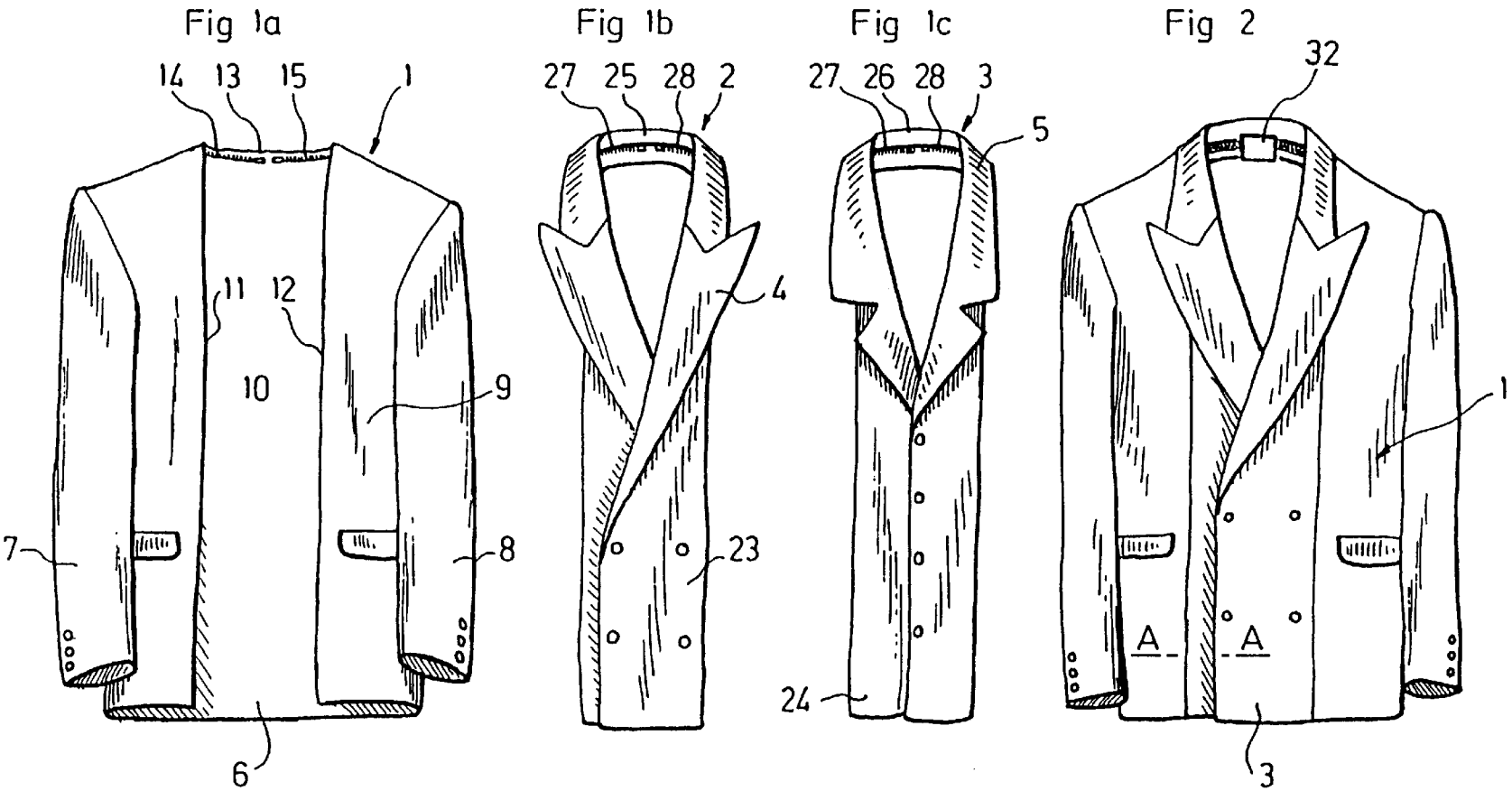
FIG. 1*a* is a front view of a jacket body conforming to the invention.
FIG. 1*b* is a front view of a first jacket dickey model in accordance with the invention.
FIG. 1*c* is a front view of a second jacket dickey model in accordance with the invention.
FIG. 2 is a front view of a jacket in accordance with the invention combined with the first jacket dickey model.

The clothing ensemble in accordance with the invention shown in FIGS. 1*a* to 1*c* is composed of a jacket body 1 and two jacket dickey models 2, 3, one having an overlapping closure and a double-breasted collar 4. The other has an edge-to-edge closure and a single-breasted collar 5.

First of all, the jacket body 1 has an overall classic shape and is composed of a back 6, two sleeves 7, 8 and a front 9 having a median opening 10 with vertical edges 11, 12 extended, at the top of the back 6, by a horizontal edge 13 forming a neck opening.

This jacket body 1 is additionally equipped along each of its vertical edges 11, 12 and its neck opening 13 with two zipper bands 14, 15 sewn onto the reverse side of the jacket body 1, set back laterally with respect to said edges and neck opening.

These two zipper bands 14, 15 extend from the midline of the neck opening 13, are each sewn along half the length of this opening 13 and along the vertical edge 11, 12, and they stop at right angles to the bottom of the jacket body 1.

Additionally, one of these bands 14 (providing the right vertical edge 11 of the jacket body 1 referring to FIG. 1*a*) consists of a zipper element fitted with a stop pin 16 and a slide 17 equipped with a pull handle 18. The other band 15 (providing the left vertical edge 12 of the jacket body 1 referring to FIG. 1*a*) consists of a complementary zipper element devoid of a cursor and typically comprising an insertion notch (not shown) for a slide.

Figure 5:
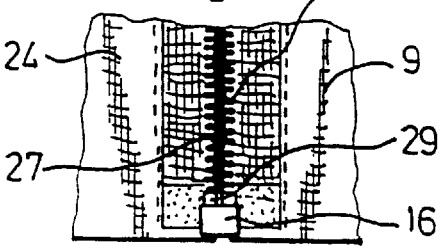
FIG. 5 is a partial view showing, from the inside of the jacket, the attachment, in the lower section, of a jacket body and a jacket dickey model.

Moreover, as shown in FIG. 5, the band 14 is arranged so that the stop pin 16 is positioned at a right angle to the bottom of the jacket body 1. As for the other band 15, it is oriented so that the insertion notch is positioned at a right angle to the bottom of the jacket body 1.

Figure 4:
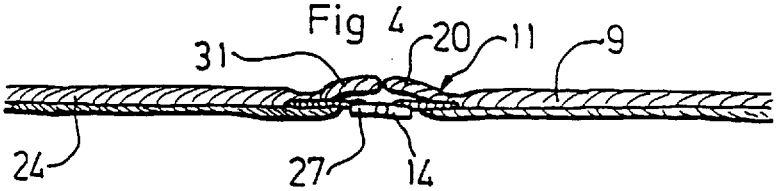
FIG. 4 is an enlarged cross section along plane A showing the attachment of the vertical edges of a jacket body and a jacket dickey model.

Additionally, as shown in FIGS. 4 and 5, the two zipper bands 14, 15 are set in on the reverse side of the jacket body 1 in inverse fashion to a traditional mounting, so that the pull handle 18 of the slide 17 extends on the inside of the jacket body 1.

Figure 3A:
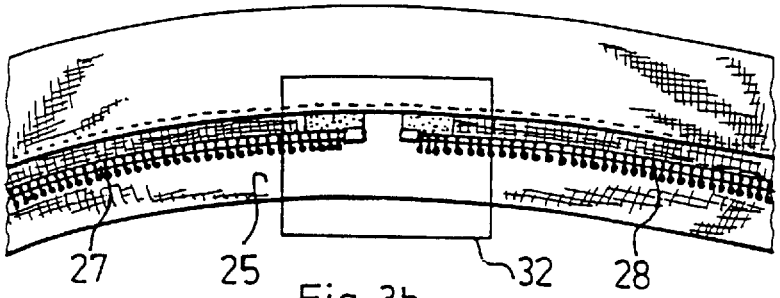
FIG. 3*a* is a partial enlarged view of the collar sham of a jacket dickey model in accordance with the invention on which only the contours of the label are shown.
Figure 3B:
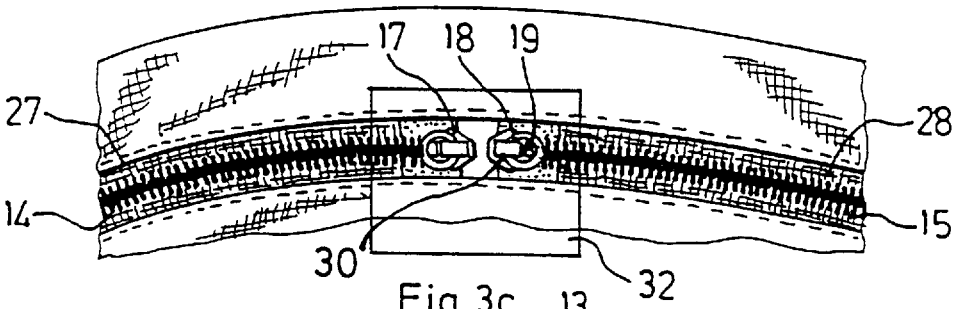
FIG. 3*b* is a partial enlarged view of the collar sham of a jacket in accordance with the invention, on which only the contours of the label are shown.
Figure 3C:
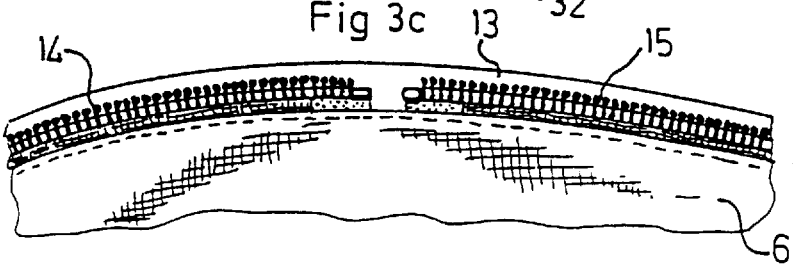
FIG. 3*c* is a partial enlarged view of the neck opening of a jacket body in accordance with the invention.

Moreover, as shown in FIG. 3*b*, the pull handle 18 of the slide 17 has a ring shape, and this slide 17 comprises a protruding tab 19 of a shape suited to lodging itself inside the pull handle 16 and in this manner locking this pull handle into a position in which it lies flat against said slide.

Finally, as shown in FIG. 4, the jacket body 1 comprises at right angles to each of its vertical edges 11, 12 a longitudinal overlapping border 20 that covers the outside of the corresponding zipper band 14, 15.

The jacket dickey models 2, 3 shown in FIGS. 1*b* and 1*c* are adapted so that they can be attached continuously to the jacket body 1, and each comprises in a single piece a front, 23, 24 respectively, having a cut edge paired with the opening 10 of the jacket body 1, a collar sham, 25, 26 respectively, and a jacket collar, 4, 5 respectively.

As indicated earlier, jacket dickey model 2 comprises a front 23 having an overlapping closure and a double-breasted collar 4. In the example shown in FIG. 1*b*, the front 23 has a double buttoning system and the double-breasted collar 4 is a narrow notched collar.

Nevertheless, a range of jacket dickeys 2 can be created allowing one to achieve different double-breasted jacket models using a single jacket body 1, by producing different button fastenings (for example from one to eight buttons), and by giving these jacket dickeys either a narrow notched collar or a wide notched collar.

As also indicated earlier, jacket dickey model 3 comprises a front 24 having an edge-to-edge closure and a single-breasted collar 5. In the example shown in FIG. 1*c*, the front 24 has a four-button fastening, and the collar 5 is a lapel collar. Nevertheless, a range of jacket dickeys 3 can be created so as to achieve different single-breasted jacket models using a single jacket body 1 by creating different button fastenings (for example two to four buttons), and by giving these jacket dickeys either a tunic collar or a narrow notched or wide notched lapel collar.

Each of the dickey models 2, 3 shown in FIGS. 1*b* and 1*c* is additionally equipped along each of the vertical edges of the front 23, 24, and of the reverse side of the collar sham 25, 26 with two zipper bands 27, 28 that are complementary to the zipper bands 14, 15 of the jacket body 1, i.e., arranged so as to form with the zipper bands of the jacket body two zipper closures.

To this end, these two bands 27, 28 extend roughly from the midline of the collar sham 25, 26, are each sewn onto the reverse side of said collar sham and along the vertical edges of the front 23, 24, set back laterally with respect to said edges, and stop at right angles to the bottom of the front 23, 24.

Additionally, as shown in FIG. 5, one of these bands 27, complementary to the band 14 of the jacket collar 1, consists of a zipper element devoid of any slide, and comprises an insertion notch 29 for the slide 17 of the band 14 of the jacket body 1, positioned at a right angle to the bottom of the jacket dickey 2, 3.

As shown in FIG. 3*b,* the other band 28, complementary to the band 15 of the jacket body 1, consists of a zipper closure equipped with a slide 30 and a stop pin (not shown) positioned at a right angle to the bottom of the jacket dickey 2, 3.

Moreover, in the same manner as the zipper bands 14, 15 of the jacket body, bands 27, 28 of jacket dickey models 2, 3 are sewn onto the reverse side of these dickey models in inverse fashion to a traditional mounting. Moreover, the slide 30 has the same design as the slide 17 of band 14 of the jacket body 1.

Additionally, as shown in FIG. 4, each jacket dickey model 2, 3 comprises at right angles to each of the vertical edges of the fronts 23, 24 a longitudinal overlapping border 31 that covers the outside of the corresponding zipper band 27, 28.

Finally, each jacket dickey model 2, 3 comprises a label 32 sewn onto the reverse side of the collar sham 25, 26 in the middle section of this collar sham, adapted so that it can be turned down over the slides 17, 30 of zipper bands 14, 28.

Such a clothing ensemble makes it possible to achieve a single-breasted jacket or a double-breasted jacket having a traditional appearance owing to the arrangement of the zipper closures 14–27, 13–28 and to the presence of borders 20, 31 that insure a virtually invisible connection between the jacket body 1 and the jacket dickey models 2, 3 along the entire vertical length of the jacket front.

Figure 6:
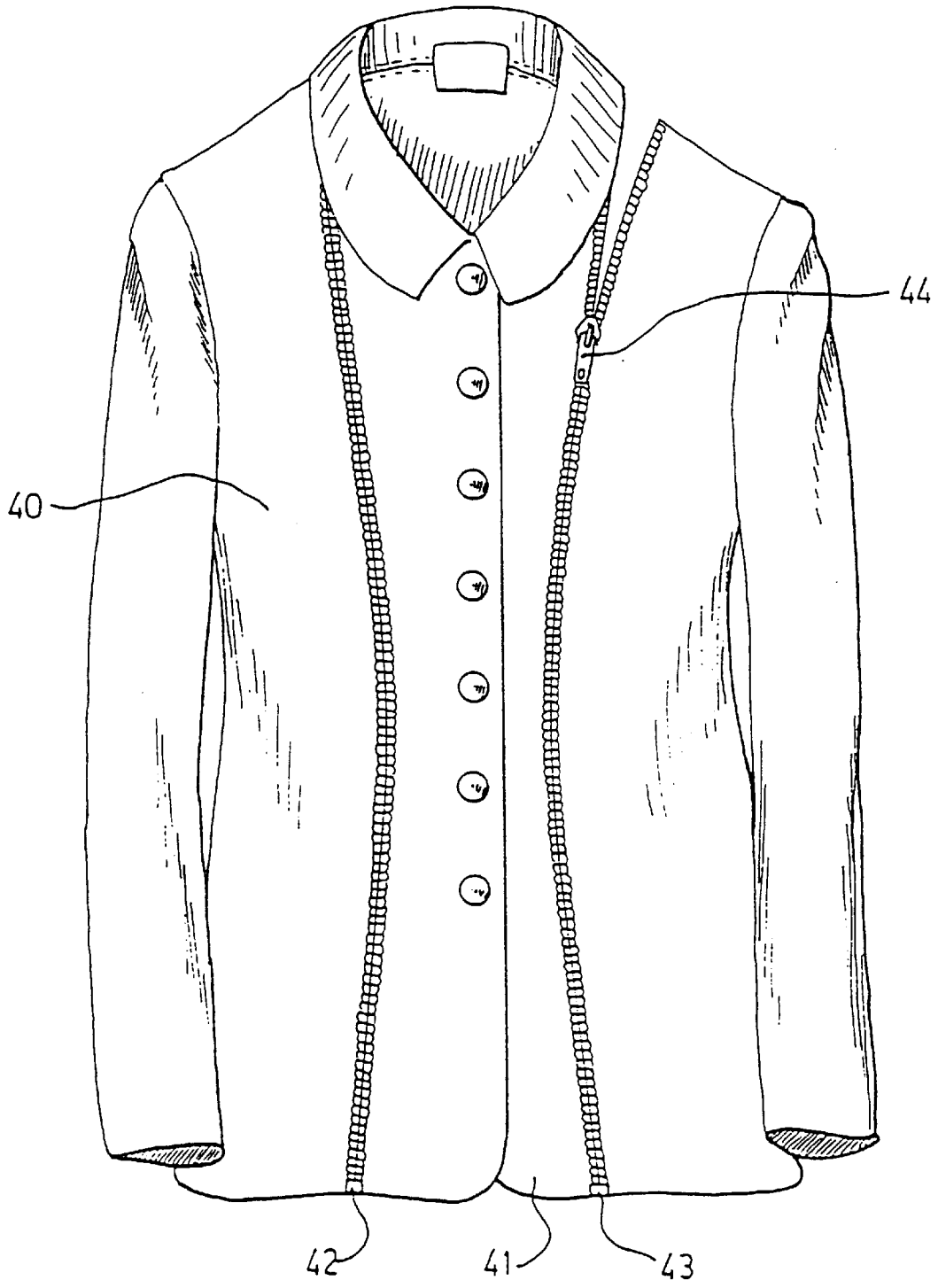
FIG. 6 is a front view of a jacket variation in accordance with the invention, shown with one of the zippers partially raised.

The clothing ensemble shown in FIG. 6 similarly comprises a jacket body 40 and jacket dickey models such as 41 (of which a single model is shown in the drawings) of a same design as those described above.

The particularity of this clothing ensemble resides in the fact that the connection between the jacket body 40 and the jacket dickey is achieved using zippers 42, 43 sewn along the vertical edges of the opening of the jacket body 40 and the cut edge of the jacket dickey 41 so that they are visible, the pull handles such as 44 facing toward the outside of the jacket and lodging themselves under the collar, at the back of the collar.

This arrangement gives an original aesthetic quality to the clothing ensemble.

What I claim is:

1. A clothing ensemble for forming a convertible jacket, the ensemble comprising:

a jacket body including a front median opening defined by opposing vertical edges which are continuous with a horizontal edge at the top of the back of said jacket body;

a first jacket dickey model comprising:

a front having vertical edges corresponding with said vertical edges of said jacket body;

a collar sham;

a single breasted jacket collar; and an edge-to-edge closure; and a second jacket dickey model comprising:

a front having vertical edges corresponding with said vertical edges of said jacket body;

a collar sham;

a double breasted jacket collar; and an overlapping closure;

wherein said first and second jacket dickey models are each detachably attachable to said jacket body along said vertical edges and said horizontal edge of said jacket body and said vertical edges and said collar sham of said first and second jacket dickey models, thereby forming a single breasted jacket or double breasted jacket, respectively.

2. The ensemble of claim 1, comprising a continuous attachment device provided along said vertical edges and said horizontal edge of said jacket body, and said vertical edges and said collar sham of said first and second jacket dickey models, respectively.

3. The ensemble of claim 2, wherein said continuous attachment device is a zipper comprising first and second zipper bands provided along said vertical edges and said horizontal edge of said jacket body, and along said vertical edges and said collar sham of said first and second jacket dickey models, respectively, one of said first and second zipper bands including a zipper slide having a pull handle.

4. The ensemble of claim 3, wherein said first and second zipper bands are provided on an interior side of said jacket body and said first and second jacket dickey models, respectively, whereby said pull handle of said zipper slide faces an interior of the jacket.

5. The ensemble of claim 3, wherein said vertical edges of said jacket body and said vertical edges of said first and second jacket dickey models each includes an overlapping border portion covering said first and second zipper bands, respectively.

6. The ensemble of claim 3, wherein said first and second zipper bands are provided on an exterior side of said jacket body and said first and second jacket dickey models, respectively, whereby said pull handle of said zipper faces an exterior of the jacket.

7. The ensemble of claim 3, wherein said first zipper band includes a first zipper band subportion along one said vertical edge and approximately one-half of said horizontal edge of said jacket body and a second zipper band subportion along said other vertical edge and the other one-half of said horizontal edge of said jacket body, said first zipper band subportion including a first zipper slide, wherein said second zipper band includes a third and fourth zipper band subportions on said first and second jacket dickey models which are complimentary to said first and second zipper band subportions on said jacket model, respectively, said fourth zipper band subportion including a second zipper slide, wherein said zipper slides are movable from a bottom of their respective zipper band subportions for attaching one of said first and second jacket dickey models to said jacket body.

8. The ensemble of claim 7, wherein said first and second jacket dickey models each include a label formed on an interior side of said collar sham, said label being turnable downward so as to cover said first and second zipper slides when one of said first and second jacket dickey models is attached to said jacket body.

9. The ensemble of claim 8, wherein said first and second zipper slides each includes a ring-shaped pull handle and said first and second zipper slides each include a protruding tab to which said respective ring-shaped pull handles are attached, said ring-shaped pull handles being lockable in a position flat against said first and second zipper slides respectively.

10. The ensemble of claim 1, wherein said single breasted collar is any one of a tunic collar, a narrow notched collar, and a wide notched lapel collar.

11. The ensemble of claim 1, wherein said double breasted collar is one of a narrow notched collar and a wide notched collar.

12. The ensemble of claim 3, wherein said first zipper band includes a first zipper band subportion along one said vertical edge and approximately one-half of said horizontal edge of said jacket body and a second zipper band subportion along said other vertical edge and said other one-half of said horizontal edge of said jacket body, said first zipper band subportion including a first zipper slide having a first pull handle, wherein said second zipper band includes a third and fourth zipper band subportions on said first and second jacket dickey models which are complimentary to said first and second zipper band subportions on said jacket model, respectively, said fourth zipper band subportion including a second zipper slide having a second pull handle, wherein said first and second zipper band subportions and said third and fourth zipper band subportions are provided on an exterior of said jacket body and said first and second jacket dickey models, respectively, whereby said first and second pull handles face an exterior of the jacket.

13. The ensemble of claim 6, wherein said first and second zipper slides each includes a ring-shaped pull handle and said first and second zipper slides each include a protruding tab to which said respective ring-shaped pull handles are attached, said ring-shaped pull handles being lockable in a position flat against said first and second zipper slides respectively.

14. The ensemble of claim 7, wherein said first and second zipper slides each includes a ring-shaped pull handle and said first and second zipper slides each include a protruding tab to which said respective ring-shaped pull handles are attached, said ring-shaped pull handles being lockable in a position flat against said first and second zipper slides respectively.

15. The ensemble of claim 8, wherein said first and second zipper slides each includes a ring-shaped pull handle and said first and second zipper slides each include a protruding tab to which said respective ring-shaped pull handles are attached, said ring-shaped pull handles being lockable in a position flat against said first and second zipper slides respectively.

16. A jacket dickey model for attachment to a jacket body to form a jacket, the jacket dickey model including:

a front having an edge-to-edge closure;

a collar sham;

a collar; and opposite vertical edges along which, in part, the jacket dickey model is attached to the jacket body.

17. The jacket dickey model according to claim 16, wherein said collar is a single breasted collar.

18. The jacket dickey model according to claim 16, wherein said collar is a double breasted collar.

19. The jacket dickey model according to claim 16, wherein said vertical edges and said collar sham are provided with a continuous attachment device by which the jacket dickey model is attached to the jacket body.

* * * * *